US005570702A

United States Patent [19]

Forman

[11] Patent Number: 5,570,702

[45] Date of Patent: Nov. 5, 1996

[54] PROPHYLACTIC DEVICE FOR A MOUTHPIECE

[76] Inventor: David Forman, 3008 Bedminster Rd., Perkasie, Pa. 18944

[21] Appl. No.: 593,771

[22] Filed: Jan. 29, 1996

[51] Int. Cl.[6] ..... A61F 6/02; A61C 5/14

[52] U.S. Cl. ..... 128/842; 128/859; 128/861

[58] Field of Search ..... 128/845, 846, 128/858–862, 204.18, 204.23, 204.25, 205.24, 842; 2/2

[56] References Cited

U.S. PATENT DOCUMENTS

| | | | |
|---|---|---|---|
| 3,692,025 | 9/1972 | Greenberg | 128/861 |
| 4,079,735 | 3/1978 | Gaffney | 128/204.18 |
| 4,640,273 | 2/1987 | Greene | 128/861 |
| 4,996,982 | 3/1991 | Williamson | 128/205.24 |

*Primary Examiner*—Michael A. Brown
*Attorney, Agent, or Firm*—LaMorte & Associates

[57] ABSTRACT

A prophylactic device and associated method for preventing contamination between the mouth and a mouthpiece. The prophylactic device is a generally tubular structure, having a two open ends, that is made of a highly elastic and water impermeable material such as latex. The tubular structure is configured to conform to the contours of the mouthpiece as the mouthpiece is placed within the tubular structure. As the tubular structure is pulled over the mouthpiece, the tubular structure stretches and conforms to the mouthpiece, thus creating a watertight seal against the mouthpiece. When applied to a mouthpiece, the tubular structure covers the exterior surfaces of the mouthpiece. One end of the tubular structure is the folded into itself and is passed through the center of the mouthpiece, thereby protecting the interior surfaces of the mouthpiece. As a result, both the interior surfaces and the exterior surfaces of the mouthpiece are protected, thereby preventing all direct physical contact between the mouthpiece and a person's mouth and preventing any possibility of contamination between the mouthpiece and the mouth.

15 Claims, 3 Drawing Sheets

PROPHYLACTIC DEVICE FOR A MOUTHPIECE

BACKGROUND OF THE INVENTION

1. Field of the Invention

The present invention relates to disposable prophylactic devices intended for use with mouthpieces, such as those used with snorkels and scuba gear. More specifically, the present invention relates to disposable latex-based prophylactic devices that conform to the contours of a mouthpiece and provide a physical barrier between the mouthpiece and the mouth when the mouthpiece is placed into the mouth.

2. Prior Art Statement

Many sports and recreational activities use equipment that includes a mouthpiece. Each time a mouthpiece is used, it becomes contaminated with the saliva and germs of the person using the mouthpiece. For people who own their own equipment, mouthpiece contamination is not a primary concern. However, in many instances, such as scuba diving or snorkeling, the needed equipment is often borrowed or rented. In such situations, mouthpiece contamination does become a major concern because many other people may have previously used the same mouthpiece without the mouthpiece being sanitized between uses. For instance, many people vacation in tropical third world locations such as the Caribbean, Central America and the South Pacific. At many such vacation destinations, scuba gear and snorkeling gear is available for renting. Scuba gear and snorkeling gear contain large mouthpieces that come in direct contact with the mouth, teeth and tongue of the person renting the equipment. When a person is finished with the rented equipment, it is returned to the rental center. Since mouthpieces are attached to larger pieces of equipment, the mouthpieces are often not sterilized and, in many cases, are not even washed. As a result, the person to next rent the scuba gear or snorkeling gear is exposed to the germs of the previous renter and perhaps even several of the previous renters. Even if the mouthpieces are washed, often the water used to clean the mouthpieces is not sterile and the washing process itself contaminates the mouthpieces.

Even people who own their own diving gear have difficulty keeping the mouthpiece sanitary prior to use. Diving gear such as snorkels and scuba regulator mouthpieces often come into contact with the deck surfaces of the boat prior to being used. The decks of many boats are contaminated with stagnant water, fish innards and a variety of other contaminants that a diver would not want to place in his/her mouth.

Recognizing the danger of spreading viruses and other communicable diseases, some prophylactic devices have been developed in the prior art for use with certain types of mouthpieces. Such prophylactic devices are typically designed for use on mouthpieces that extend from medical equipment. For example, U.S. Pat. No. 5,253,658 to King, entitled PATIENT MOUTHPIECE DEVICE WITH CONTAMINATION SHIELD and U.S. Pat. No. 5,092,328 to Fitz, entitled MOUTHPIECE ASSEMBLY WITH DISPOSABLE LINER FOR BREATHING APPARATUS, both show disposable protectors that attach to the mouthpiece at the end of a medical breathing tube. Although such prior art devices are useful in maintaining sanitary conditions for medical equipment mouthpieces, such prior art devices do not create watertight seals against the mouthpieces they protect. As a result, such prior art devices cannot be used on mouthpieces that are used under water, such as scuba regulator mouthpieces or snorkel mouthpieces.

Mouthpieces that are used under water, such as those used when scuba diving or snorkeling, contain an enlarged flange that is placed inside the mouth between the teeth and lips. A bite plate extends inwardly from the flange, wherein the teeth are used to firmly grip the bite plate and hold the mouthpiece in place. The lips pass over the flange of the mouthpiece and create a watertight seal around the mouthpiece. As such, when a diver is swimming under water, the water cannot pass between the lips of the diver and the mouthpiece. If a rigid prior art prophylactic device, such as those shown in the King patent or the Fitz patent, were placed around the mouthpiece of scuba equipment or a snorkel, the presence of the prophylactic device would prevent the lips from sealing against the mouthpiece. As a result, water would be able to enter the mouth of the diver at the seam between the prophylactic device and the mouthpiece. Consequently, the use of a prior art prophylactic device would render the mouthpiece unusable by a diver.

A need therefore exists for a disposable prophylactic device that can be used on a mouthpiece under water, wherein the prophylactic device prevents physical contact between the mouth and the mouthpiece yet enables the mouth to form a watertight seal around the mouthpiece. This need is satisfied by the present invention as described below.

SUMMARY OF THE INVENTION

The present invention is a prophylactic device and associated method for preventing contamination between the mouth and a mouthpiece. The prophylactic device is a generally tubular structure, having two open ends, that is made of a highly elastic and water impermeable material such as latex. The tubular structure is configured to conform to the contours of the mouthpiece as the mouthpiece is placed into the tubular structure. As the tubular structure is pulled over the mouthpiece, the tubular structure stretches and conforms to the mouthpiece, thus creating a watertight seal against the mouthpiece. The watertight seal prevents water from leaking passed the prophylactic device, thereby enabling the prophylactic device to be used on mouthpieces that are used under water, such as scuba diving mouthpieces and snorkel mouthpieces. When applied to a mouthpiece, the tubular structure covers the exterior surfaces of the mouthpiece. One end of the tubular structure is then folded into itself and is passed through the center of the mouthpiece, thereby protecting the interior surfaces of the mouthpiece. As a result, both the interior surfaces and the exterior surfaces of the mouthpiece are protected, thereby preventing all direct physical contact between the mouthpiece and a person's mouth and preventing any possibility of contamination between the mouthpiece and the mouth.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention prophylactic device can be used to protect many types of mouthpieces, such as medical breathing tube mouthpieces and the like, the present invention prophylactic device is especially well suited to protect underwater mouthpieces, such as those used when scuba diving or snorkeling. Accordingly, the present invention prophylactic device will be described in conjunction with an underwater mouthpiece by way of an exemplary embodiment.

Figure 1:
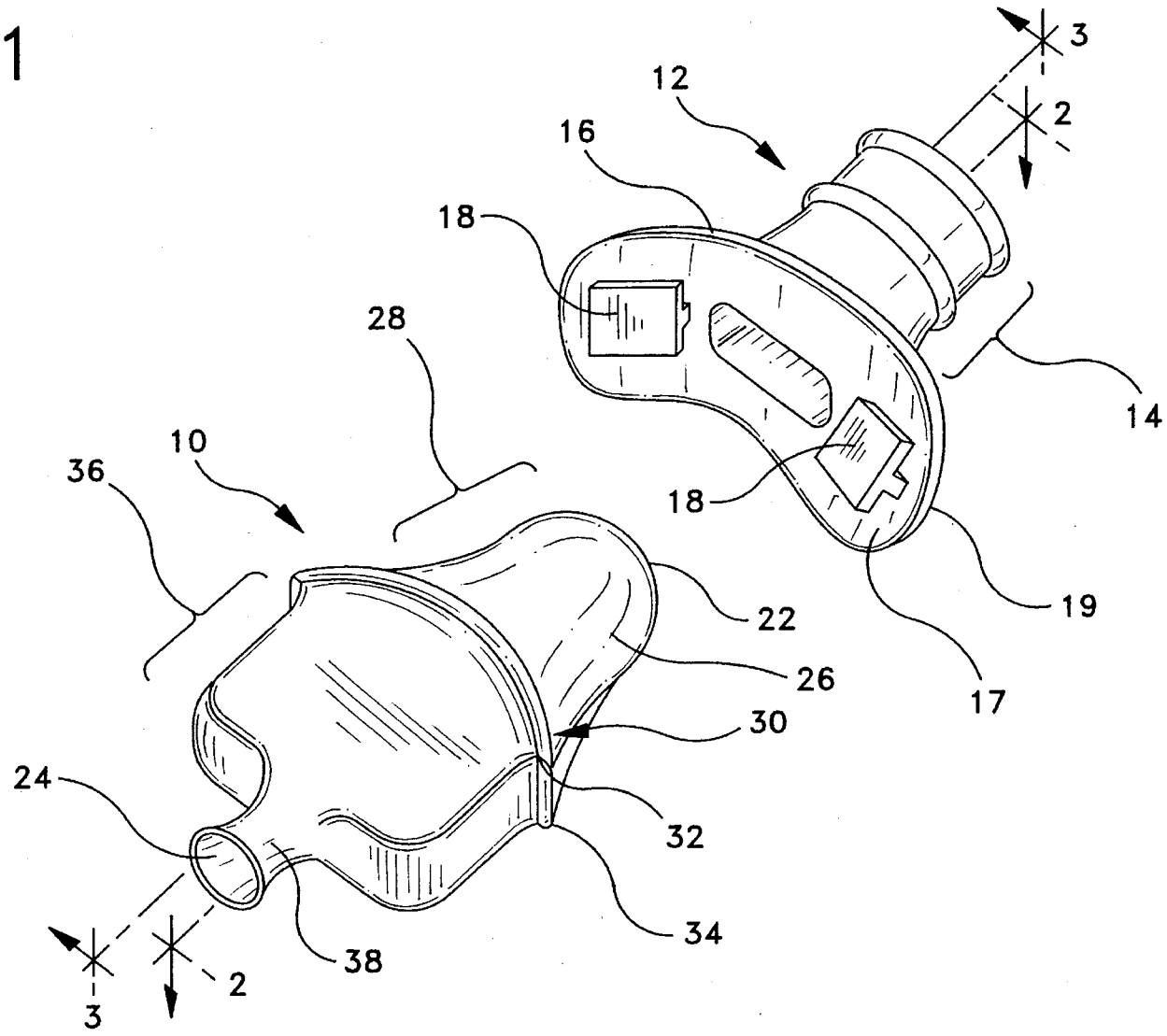
FIG. 1 is a front perspective view of one preferred embodiment of the present invention prophylactic device shown in conjunction with a prior art mouthpiece.

Referring to FIG. 1, a preferred embodiment of the present invention prophylactic device 10 is shown in conjunction with a mouthpiece 12. The mouthpiece 12 is typical of those used by divers on snorkels and with scuba diving equipment. The mouthpiece 12 has a hollow stem region 14 that attaches to a snorkel or to a scuba air supply hose. The stem region 14 leads into an enlarged flange 16 that is sized to be received within a diver's mouth between the teeth and lips. As a diver's lips pass over the enlarged flange 16, the diver's lips seal against the stem region 14, thereby creating a watertight seal between the diver's mouth and the mouthpiece 12. The shown prior art mouthpiece 12 also includes two bite plates 18 that extend from the interior surface 17 of the enlarged flange 16. The bite plates 18 extend between the upper and lower teeth of the diver, thereby enabling the diver to bite down upon the bite plates 18 and rigidly hold the mouthpiece 12 within the mouth. During normal use, the diver's teeth contact the bite plate 18, the diver's gums contact the interior surface 17 of the enlarged flange 16 and the diver's lips contact the exterior surface 19 of the enlarged flange 16 as well as the stem region 14 of the mouthpiece 12. All of these surfaces become contaminated by the diver's mouth if no protection is used.

The present invention prophylactic device 10 covers the mouthpiece 12, thereby preventing any direct contact between the diver's mouth and every surface of the mouthpiece 12. As a result, a diver can use a rented or borrowed mouthpiece 12 without concern of mouthpiece cleanliness. In the shown embodiment, the present invention prophylactic device 10 is a latex molded product that is designed to conform to the contours of the mouthpiece 12 and create a water impervious seal against the various surfaces of the mouthpiece 12. The prophylactic device 10 is manufactured with a tubular construction, having two open ends 22, 24 and a continuous exterior structure 26 that extends between the two open ends 22, 24. As will be explained, the shape of the exterior structure 26 is configured so that the exterior structure 26 conforms to the contours of the mouthpiece 12 when the prophylactic device 10 is stretched over the mouthpiece 12.

Figure 2:
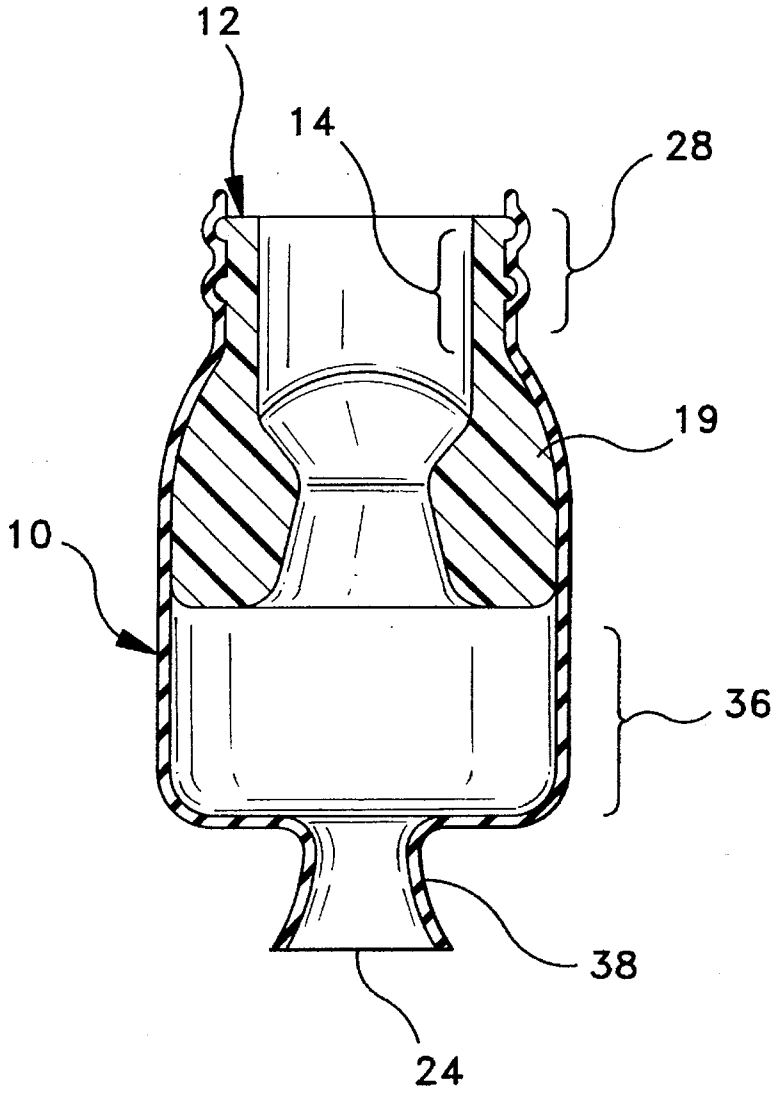
FIG. 2 is a cross-sectional view of the present invention prophylactic device and prior art mouthpiece of FIG. 1 shown in a partial state of assembly and viewed along section line 2—2.
Figure 3:
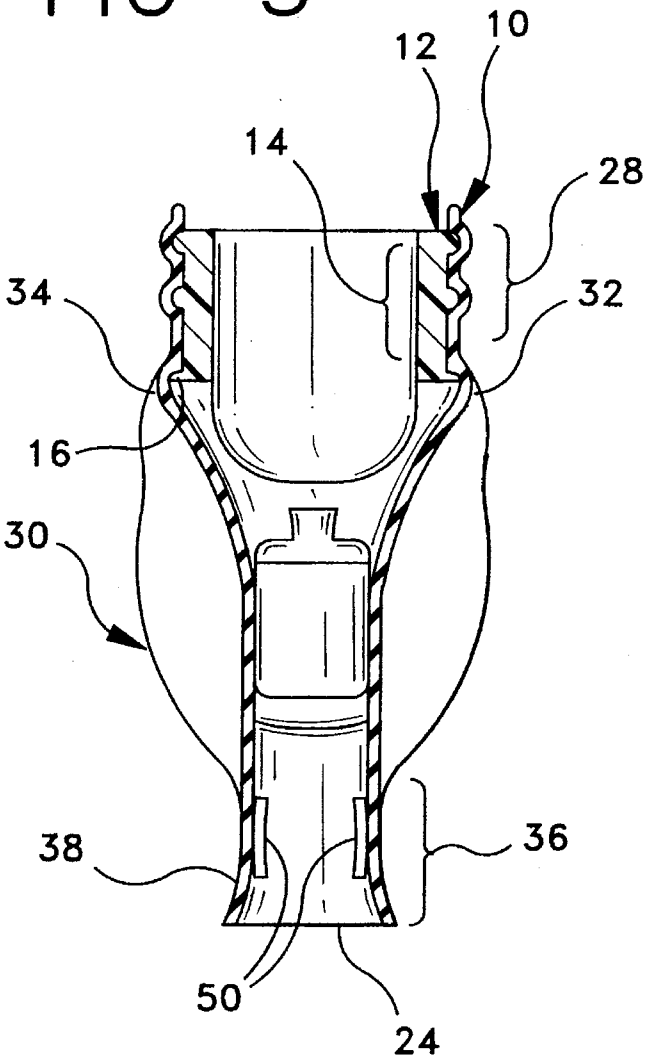
FIG. 3 is a cross-sectional view of the present invention prophylactic device and prior art mouthpiece of FIG. 1 shown in a partial state of assembly and viewed along section line 3—3.

Referring to FIG. 1 in conjunction with FIG. 2 and FIG. 3, it can be seen that the prophylactic device 10 is stretched over the mouthpiece 12 by either stretching open the first open end 22 or the second open end 24 of the prophylactic device 10 and inserting the mouthpiece 12 into the prophylactic device 10. The prophylactic device 10 is preferably made of latex or a similar elastic material, such as silicon rubber, that would enable the prophylactic device 10 to be stretched over the mouthpiece 12 without damage and remain stretched over the contours of the mouthpiece 12 without rupturing. In the shown embodiment, the prophylactic device 10 contains a cylindrical section 28 that leads toward the first open end 22. The cylindrical section 28 is sized to stretch over and conform to the stem region 14 of the mouthpiece 12. The degree to which the cylindrical section 28 of the prophylactic device 10 stretches to conform to the stem region 14 of the mouthpiece 12 is selected so that the cylindrical section 28 of the prophylactic device 10 is stretched taut enough to create a watertight seal against the stem region 14 of the mouthpiece 12.

The cylindrical section 28 of the prophylactic device 10 extends into an enlarged crescent-shaped section 30. The crescent-shaped section 30 of the prophylactic device 10 is sized to conform to the contours of the enlarged flange 16 on the mouthpiece 12 when the prophylactic device 10 is stretched over the mouthpiece 12. As shown in FIG. 2, the crescent-shaped section 30 of the prophylactic device 10 enables the prophylactic device 10 to conform to the exterior surface 19 of enlarged flange 16, while still engaging the stem region 14 of the mouthpiece 12 in a watertight manner. As is shown in FIG. 3, the crescent-shaped section 30 includes a top protrusion 32 and a bottom protrusion 34 that enables the prophylactic device 10 to pass over the enlarged flange 16 of the mouthpiece 12 and conform to both the interior surface 17 and the exterior surface 19 of the enlarged flange 16.

While still referring to FIGS. 1, 2 and 3, it can be seen that the prophylactic device 10 tapers down to a squared section 36 from the top protrusion 32 and bottom protrusion 34 that are disposed along the edge of the crescent-shaped section 30. Initially, the squared section 36 extends well passed the area of the mouthpiece 12 for a purpose which will later be described. The squared section 36 then narrows to a neck section 38 that terminates at the second open end 24. The neck section 38 is flared at the second open end 24, thereby making it easier to grasp the second open end 24 and pull the second open end 24 over the mouthpiece 12.

Figure 4:
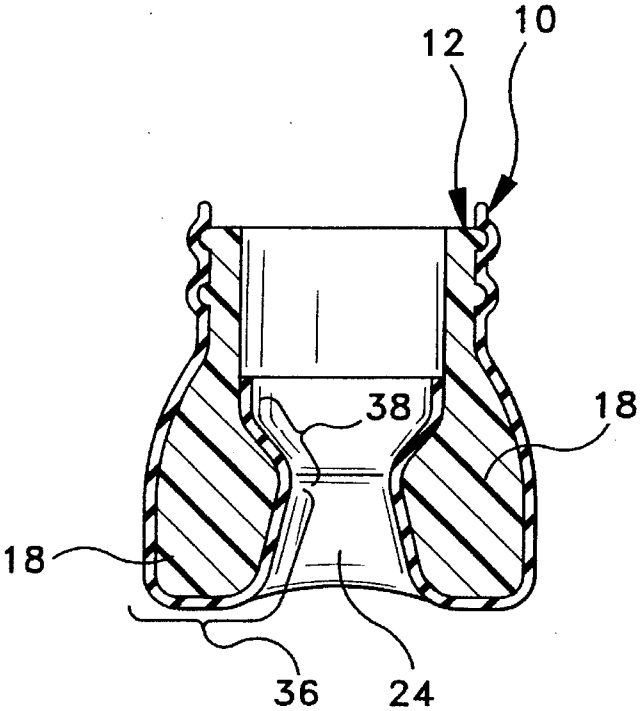
FIG. 4 is a cross sectional view of the present invention prophylactic device and prior art mouthpiece of FIG. 1 shown in a full state of assembly and viewed along section line 2—2.

Referring now to FIG. 4, it can be seen that to complete the application of the prophylactic device 10 to the mouthpiece 12, the neck section 38, proximate the second open end 24, and the squared section 36 are pushed inwardly into the center of the mouthpiece 12. As the neck section 38 is invaginated, the squared section 36 of the prophylactic device 10 conforms to the contours of the two bite plates 18 while still providing a central opening 40 between the two bite plates 18 through which air can pass. Once inverted, the neck section 38 extends into the interior of the stem region 14 of the mouthpiece 12, thereby completing a prophylactic envelope around all the surfaces of the mouthpiece 12 that come into contact with the mouth. The flared construction of the second end 24 causes the second end 24 to expand and contact the interior of the mouthpiece stem section 14, thereby preventing the second end 24 from obstructing the flow of air through the mouthpiece 12.

After the prophylactic device 10 is applied to a mouthpiece 12, it can be seen that the prophylactic device 10 provides a physical barrier between all surfaces, both on the interior and exterior of the mouthpiece 12, that come into direct contact with the mouth, teeth and tongue of the person utilizing the mouthpiece 12. Consequently, germs from the mouth are prevented from contacting the mouthpiece 12 and vice versa.

Since the present invention prophylactic device 10 is made of an elastic, water impermeable material, such as latex, the prophylactic device 10 stretches across the various surfaces of the mouthpiece 12 as the mouthpiece 12 is passed into the prophylactic device 10. The dimensions of the prophylactic device 10 are intentionally made to be smaller than the corresponding dimensions of the mouthpiece 12. As a result, the prophylactic device 10 is pulled taut against the surfaces of the mouthpiece 12 when pulled around the mouthpiece 12. The tautness of the prophylactic device 10 causes the prophylactic device 10 to seal against the mouthpiece 12 in a water impermeable manner, thereby preventing water from flowing between the prophylactic device 10 and the mouthpiece 12 when the mouthpiece 12 is submerged.

Referring back to FIG. 3, it can be seen that the prophylactic device 10 has reinforced sections 50 that are molded to be generally thicker that the remainder of the other regions. In an optional embodiment, the reinforced sections 50 can be molded at locations where the reinforced sections 50 lay across the bite plates 18 on the mouthpiece 12, when the prophylactic device 10 is fully applied to the mouthpiece 12. As a result, when a person bites down upon the bite plates 18, the teeth would engage the reinforced regions 50 of the prophylactic device 10, wherein the reinforced regions 50 would better resist being ruptured by the teeth.

The present invention prophylactic device 10 is preferably wrapped in an individual package during manufacture. As such, each prophylactic device 10 can remain sterile until the time it is used. Furthermore, the package for the prophylactic device 10 may contain an antiseptic (not shown) that coats the prophylactic device 10. As such, when the prophylactic device 10 is removed from its packaging and is applied to a mouthpiece 12, the antiseptic contacts and sterilizes the mouthpiece 12, thereby providing additional sanitary protection. In alternate embodiments, the prophylactic device 10 can be manufactured in a wide variety of colors, thereby enabling a diver to choose a color of preference. Similarly, the prophylactic device 10 can be flavored in a variety of flavors, thereby providing an added novelty to the use of the prophylactic device 10. The use of non-toxic coloring and flavoring in conjunction with latex based products is well known in the art and need not be described herein.

It will be understood that the embodiment of the present invention described and illustrated herein is merely exemplary and a person skilled in the art can make many variations to the embodiment shown without departing from the scope of the present invention. There are many different mouthpiece shapes and styles used in the fields of scuba diving and snorkeling. Since many differently shaped mouthpieces exist, it will be understood that the shape of the present invention prophylactic device can be altered in order for the prophylactic device to match the contours of the mouthpiece. All such variations, modifications and alternate embodiments are intended to be included within the scope of the present invention as defined by the appended claims.

What is claimed:

1. A prophylactic device for a mouthpiece for preventing direct physical contact between the mouth and the mouthpiece, said prophylactic device comprising:

an elastic, water impermeable structure having a first open end and a second open end, said structure being sized to receive the mouthpiece therein between said first open end and said second open end, wherein said structure substantially conforms to the contours associated with the mouthpiece and creates a physical barrier between the mouthpiece and the mouth.

2. The prophylactic device according to claim 1, wherein the mouthpiece includes a stem region against which lips of the mouth seal when using the mouthpiece under water, and said structure is sized to elastically engage the stem region, thereby creating a watertight seal against the stem region.

3. The prophylactic device according to claim 1, wherein said structure is latex.

4. The prophylactic device according to claim 1, wherein said structure is flavored.

5. The prophylactic device according to claim 1, further including an antiseptic coating said structure.

6. The prophylactic device according to claim 1, wherein the mouthpiece includes an enlarged flange, at least one bite plate extending from a first surface of the enlarged flange and a stem region extending from an opposite second surface of the enlarged flange, wherein a breathing aperture extends from the first surface of the enlarged flange through the stem region, and said structure includes a first section sized to engage the stem region, a second section sized to engage the enlarged flange and a third section sized to engage at least one bite plate.

7. The prophylactic device according to claim 6, wherein the mouthpiece has a predetermined length and said structure has a length between said first open end and said second open end that is longer than said predetermined length, thereby enabling said second end of said structure to be folded into the breathing aperture of the mouthpiece.

8. The prophylactic device according to claim 1, wherein the mouthpiece contains at least one bite plate to be engaged by the teeth within the mouth and said structure includes at least one reinforced area that separates said at least one bite plate from the teeth, thereby preventing the teeth from rupturing said structure.

9. A prophylactic device for protecting a mouthpiece used under water, comprising:

a continuous latex body defining an interior region having a first open end and a second open end, wherein said interior region is sized to receive the mouthpiece therein and said latex body substantially conforms to the contours associated with the mouthpiece.

10. The prophylactic device according to claim 9, wherein said latex body is sized to elastically engage the mouthpiece and create a watertight seal against the mouthpiece.

11. A method of preventing contamination between a mouthpiece and the mouth, wherein the mouthpiece includes a hollow stem region that extends into the mouth and terminates at a flange positioned between the teeth and lips, said method comprising the steps of:

providing an elastic, water impermeable element that defines an open interior region between a first open end and an opposite second open end; and positioning said mouthpiece within said open interior region, wherein said element forms a watertight seal against said stem region of said mouthpiece and prevents direct physical contact between the mouth and said mouthpiece.

12. The method according to claim 11, said step of positioning said mouthpiece within said open interior region further includes the substeps of:

covering said hollow stem region and said flange with said element, proximate said first open end of said element; and folding said second open end of said element over said flange and inserting said second open end into said hollow stem region through said flange.

13. The method according to claim 11, further including the step of shaping said element so that said element substantially conforms to said mouthpiece when said mouthpiece is positioned within said open interior region of said element.

14. The method according to claim 11, wherein said element is latex.

15. The method according to claim 11, wherein said mouthpiece includes at least one bite plate extending from said flange and said method includes the step of covering said at least one bite plate with said element, thereby preventing direct physical contact with said at least one bite plate.

* * * * *